US005933903A

United States Patent [19]

Irwin

[11] Patent Number: 5,933,903

[45] Date of Patent: Aug. 10, 1999

[54] WASTE LINE CLEAN OUT DEVICE WITH WATER JET HEAD

[76] Inventor: Lawrence F. Irwin, 12860 San Fernando Rd., Sylmar, Calif. 91342

[21] Appl. No.: 08/895,189

[22] Filed: Jul. 16, 1997

[51] Int. Cl.[6] ..... B08B 9/02

[52] U.S. Cl. ..... 15/104.33

[58] Field of Search ..... 15/104.31, 104.33

[56] References Cited

U.S. PATENT DOCUMENTS

| | | | |
|---|---|---|---|
| 3,370,599 | 2/1968 | Ciaccio . | |
| 3,959,840 | 6/1976 | Sato | 15/104.33 |
| 4,257,139 | 3/1981 | Yeo . | |
| 4,312,679 | 1/1982 | Klein, Sr. . | |
| 4,420,852 | 12/1983 | Bowlsby . | |
| 4,773,113 | 9/1988 | Russell . | |
| 5,535,473 | 7/1996 | Maniar . | |

OTHER PUBLICATIONS

Advertisement National Drain Cleaning Equipment.Cable-.Supplies.

*Primary Examiner*—Randall E. Chin

*Attorney, Agent, or Firm*—James E. Brunton

[57] ABSTRACT

A power driving waste line clean out tool which includes an elongated flexible coil spring formed from an elongated spring wire that is helically wound about a flexible water conduit. The water conduit provides water under relatively high pressure to a uniquely designed water jet clean out head assembly that is affixed to the end of the coil spring and is adapted to effectively break up and remove blockages formed in the sewer line being cleaned. The flexible coil spring is housed within a drum having a conoidal wall through which the coil spring is fed and retracted actually of itself as the drum is rotated. The water jet head assembly of the tool includes a spray head which can be securely connected to the coil spring, a cutter head assembly which can be removably interconnected with the spray head and a connector means of unique design for interconnecting the water conduit of the coil spring assembly with the plurality of water jets provided in the spray head and extending angularly outwardly relative to longitudinal axis of the waste line.

15 Claims, 5 Drawing Sheets

WASTE LINE CLEAN OUT DEVICE WITH WATER JET HEAD

BACKGROUND OF THE INVENTION

1. Field of the Invention

The present invention relates generally to plumbers' tools. More particularly, the invention concerns a waste line clean out apparatus for removing and cleaning away obstructions formed in and blocking the waste line. The apparatus an elongated member in the form of a coil spring wire which surrounds a flexible tube that functions as a water conduit. Affixed to the free end of the tube is a uniquely designed spray jet head assembly for controllably spraying jets of water under pressure into the interior of the waste line in a direction toward the blockage cutting component of the device to assist in breaking down the obstruction. The coil spring wire and water conduit is housed within a removable drum from which it is advanced through the waste line being rotated.

2. Discussion of the Prior Art

A wide variety of waste line clean out devices have been suggested in the past. Normally such devices embody an elongated clean out member known as a plumbers' snake. The plumbers' snake is ordinarily housed within a drum or hollow housing having a conical wall through which the spring or snake is fed and retracted actually of itself as the container is rotated to cause rotation of the spring. For tools having power operated spring advancing and retracting means, the feed mechanism for advancing the coiled spring typically includes jaws, rollers, segmented nuts or like structures which grip the spring so that when the spring is fed through the feed while being rotated it is controllably advanced into or retracted from the sewer line. As a general rule, cutter means affixed to the free end of the plumbers' snake and functions to cut away and clear blockages formed in the sewer line.

One of the most successful prior art waste clean out apparatus ever devised is illustrated in U.S. Pat. No. 5,193,242 issued to the present inventor. This patent concerns an apparatus similar in some respects to the apparatus described in the present application, but does not contemplate the use of high pressure water jets for in clearing the interior of the waste line as the cutting means cuts through an obstruction formed in the water lines. Because of its pertinence to the present invention, U.S. Pat. No. 5,193,242 is hereby incorporated by reference as though fully set forth herein.

Experience has shown that the use of strategically directed high pressure water jets materially assist in breaking up and clearing away troublesome obstructions. At the same time, the high pressure water jets function to effectively clean the walls of the waste line after the obstruction has been cleared to an extent to permit free flow of the cleaning water outwardly of the waste line. Since it is important that the spray jet nozzle and the cutting tool work in cooperation to effectively break up and clear away the obstruction so as to prevent the undesirable backup of contaminated water, means must be provided to selectively interconnect various types of cutter devices to the high pressure water jet head that is affixed to the free end of the coiled spring. It is also important that reliable means be provided for interconnecting the high pressure jet nozzles with the coil spring clean out snake in a manner to permit free flow water from a source of water under pressure to the water jet outlets formed in the water jet head. In this regard, the novel coiled spring assembly of the present invention comprises three cooperating elements, namely the elongated coiled spring, the elongated flexible water carrying tube about which the spring is helically coiled and flexible connector means for connecting the coiled spring and water carrying tube to the spray jet head.

The novel water jet head assembly of the invention includes a spray jet head having a plurality of water jet passageways that are angularly disposed relative to the axis of the waste line so that they will direct a plurality of high pressure water jets in the direction of the cutter component as the cutter component cuttably engages the obstruction in the water pipe. The water jet head also includes a reduced diameter portion having a plurality of helical grooves which comprise the means for interconnecting the coil spring with the water jet head.

The important connector means of the invention for interconnecting the water passageway of the elongated flexible tube with the spray jet head comprises a uniquely designed connector element which has a threaded portion that is threadably interconnected with the spray jet head and a shank portion which is telescopically received within the flexible tube. Another important component of the coiled spring assembly is the cutter means of cutter head assembly of the invention which can be removably interconnected with the water jet head to facilitate cutting away of troublesome obstructions that may be encountered in the particular waste line being cleaned.

U.S. Pat. No. 4,312,679 issued to Klein, Sr. describes a device for cleaning clogged pipes which includes an elongated flexible tube, a heavy coil surrounding the flexible tube and a nozzle at one end of the flexible tube. The nozzle has a plurality of perforations which are in communication with the interior of the flexible tube. Unlike the apparatus of the present invention, the Klein device is specially designed for use in a method of cleaning a clogged pipe wherein the nozzle is first forced through the material clogging the pipe, water is then discharged through the perforations in the nozzle, and the nozzle is then pulled backwards towards the material clogging the pipe while water continues to be discharged through the perforations in the nozzle.

Other prior art patents which generally relate to clean out tools commonly known as "water snakes" are described in U.S. Pat. No. 3,370,599 issued to Ciaccio; 1,803,425 issued to Cunningham and 3,880,176 issued to Horne. The Horne patent discloses an apparatus for treating root infested sewer pipes and uses a sled for moving a spraying means along the pipe. Although this method may dislodge a stoppage, it will not remove or cut the roots. As will be better understood from the description which follows the apparatus of the present invention provides a number of patentably distinct advantages over the aforementioned prior art and for the first time provides a functionally sound water jet assisted sewer line clean out apparatus.

SUMMARY OF THE INVENTION

It is an object of the present invention to provide an improved power driving machine of the type which comprises an elongated flexible coil spring formed of helically wound spring wire which a centrally disposed water conduit for providing water under relatively high pressure to a uniquely designed water jet clean out head assembly that is adapted to effectively break up and remove blockages formed in the sewer line being cleaned. The flexible coil spring is housed within a drum having a conoidal wall through which the coil spring is fed and retracted actually of itself as the drum is rotated.

A particular object of the invention is to provide an apparatus of the aforementioned character in which includes water jet spray head assembly of novel design that includes a spray head which can be securely connected to the coil spring, a cutter head assembly which can be removably interconnected with the spray head and a flexible connector means of unique design having a sealed water passageway for interconnecting the water conduit of the coil spring assembly with the plurality of water jets provided in the spray head and extending angularly outwardly relative to longitudinal axis of the waste line.

Another object of the invention is to provide an apparatus of the character described in the preceding paragraphs in which the high pressure water spray head is of a novel construction that causes high pressure water jets to impinge on the blockage and cutter head assembly in a manner to cooperate therewith to assist in the quick and effective removal and clearing away of the obstruction formed in the waste line being cleaned.

Another object of the invention is to provide a water jet clean out apparatus which includes a novel tube-like, flexible connector for connecting the spray jet head with a water conduit leading to a source of water under pressure.

Another object of the invention is to provide a device of the character described in which various cutter head assemblies of the device can be easily and quickly interconnected with the water spray head so as to enable the use most appropriately configured cutting means for cleaning away the particular clogged sewer line at hand.

Another object of the invention is to provide a novel clean out apparatus which embodies a unique automatic feed for advancing the clean out snake into the waste line to be cleaned.

Another object of the invention is to provide a water assisted sewer line clean out apparatus which is highly versatile, easy to use and relatively inexpensive to manufacture.

Figure 1:
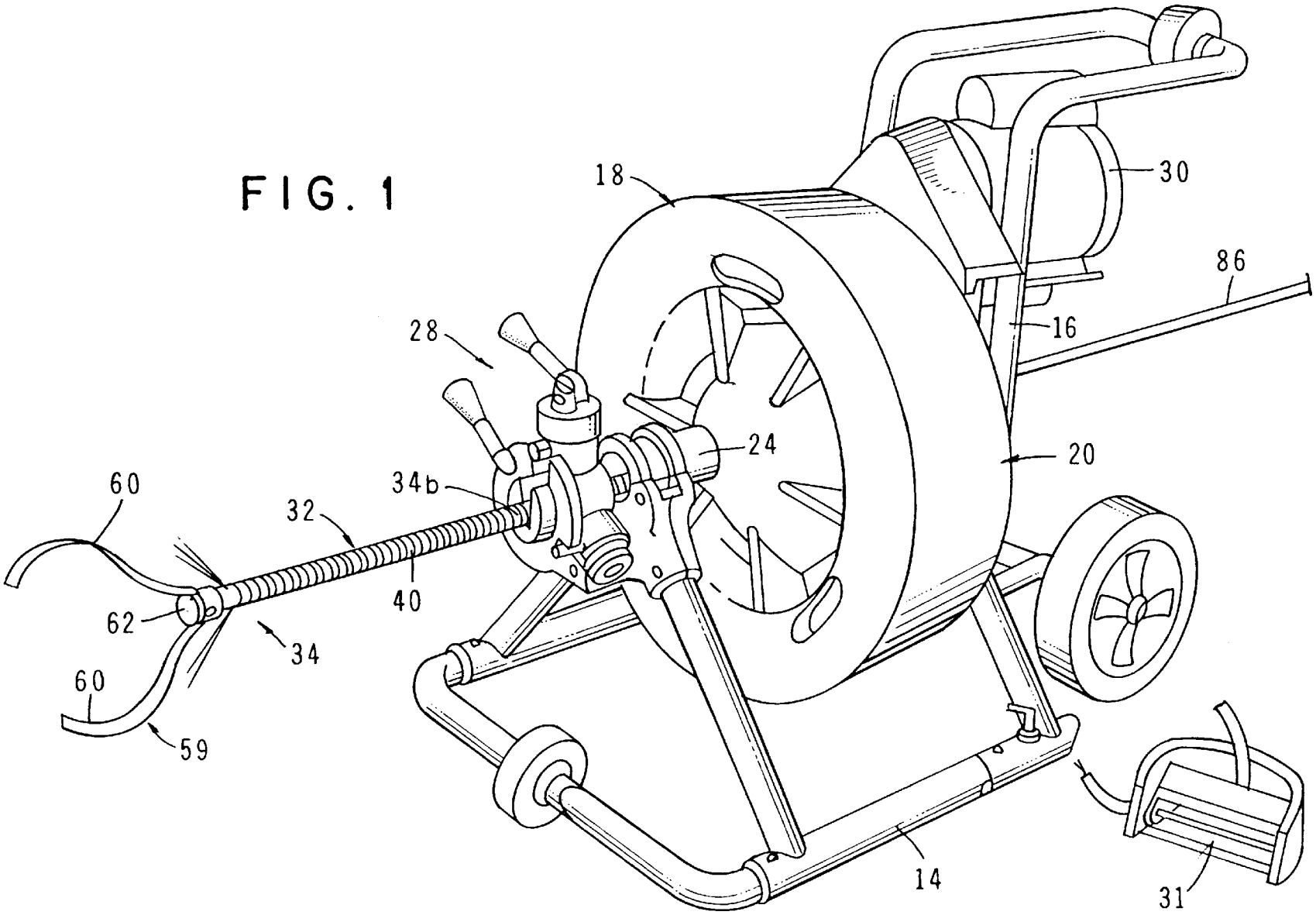
FIG. 1 is a generally perspective view of one form of the water assisted waste line clean out apparatus of the present invention.
Figures 2, 3, 3A:
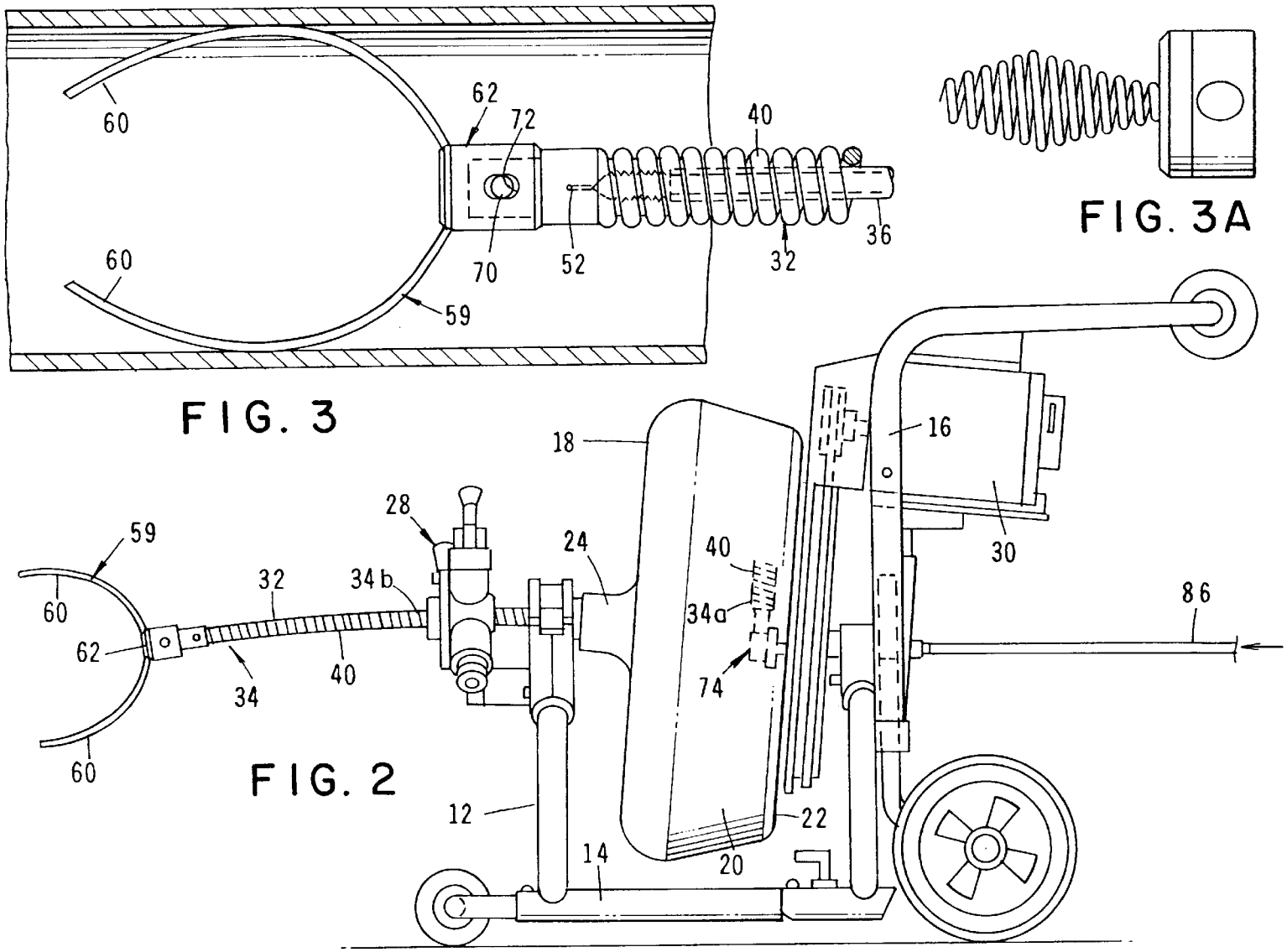
FIG. 2 is a side elevational view of the apparatus shown in FIG. 1.
FIG. 3 is a greatly enlarged view of the clean out head assembly of the invention as it appears when inserted into the waste line to be cleaned.
FIG. 3A is a side-elevational, exploded view of an alternate form of cutter head.

DESCRIPTION OF ONE FORM OF THE INVENTION to FIGS. 1, 2 and 3, one form of the waste line clean out tool of the present invention comprises a supporting frame 12, having a base portion 14, and upstanding rearwardly disposed portion 16. Rotatably connected to upstanding portion 16 is a coil spring housing 18 which houses portions of the coiled spring, or plumbers' snake. Housing 18 is of the general character illustrated and described in the incorporated by reference U.S. Pat. No. 5,193,242 and includes a generally annular shaped body portion 20 having a rear wall 22 (FIG. 2) and a generally frustoconically shaped forward guide portion 24 a generally annular shaped body portion 20 having a rear wall 22 (FIG. 2) and a generally frustoconically shaped forward guide portion 24.

A feed means, generally designated by the numeral 28, is connected to frame 12 and functions to engage the forward portion of the novel coil spring assembly of the invention in a manner to controllably withdraw the coil spring assembly from spring housing 18 and cause it to travel forwardly of the apparatus through the forward guide portion 24 of spring housing 18. The feed means of the present invention is identical to that described in incorporated by reference U.S. Pat. No. 5,193,242 and reference should be made to that patent for a detailed description of the construction and operation of this novel feed means. Similarly, the supporting frame 20 is of a construction generally similar to that shown in U.S. Pat. No. 5,193,242 and reference should be made to the patent for a more detailed discussion of the construction and assembly of the main supporting frame 12. A drive means comprising an electric motor 30 is carried by the upstanding portion 16 of frame 12 and can be energized by a foot switch 31 (FIG. 1) to controllably rotate spring housing 18 about the central axis thereof. Once again this drive means is of a generally similar construction to that described in U.S. Pat. No. 5,193,242.

Figure 4:
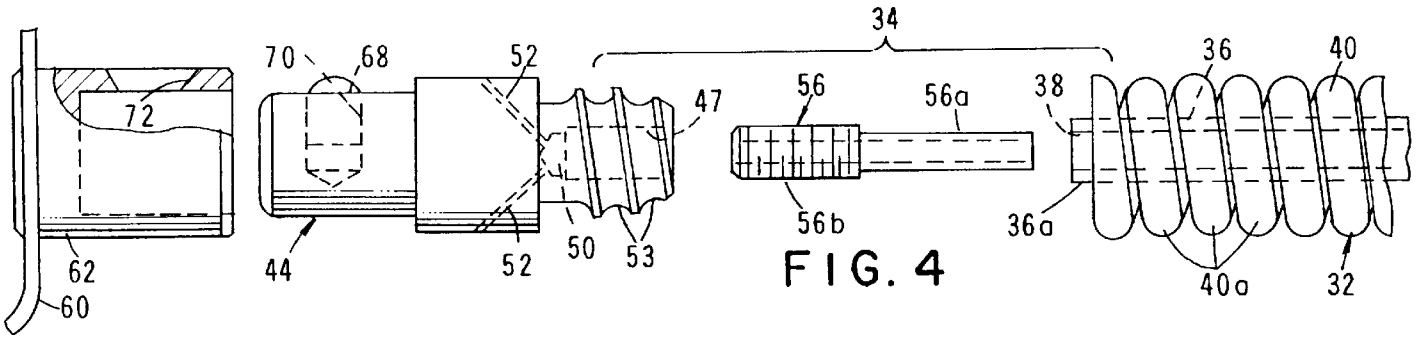
FIG. 4 is a side-elevational, exploded view of one form of the coiled spring assembly of the invention.
Figure 5:
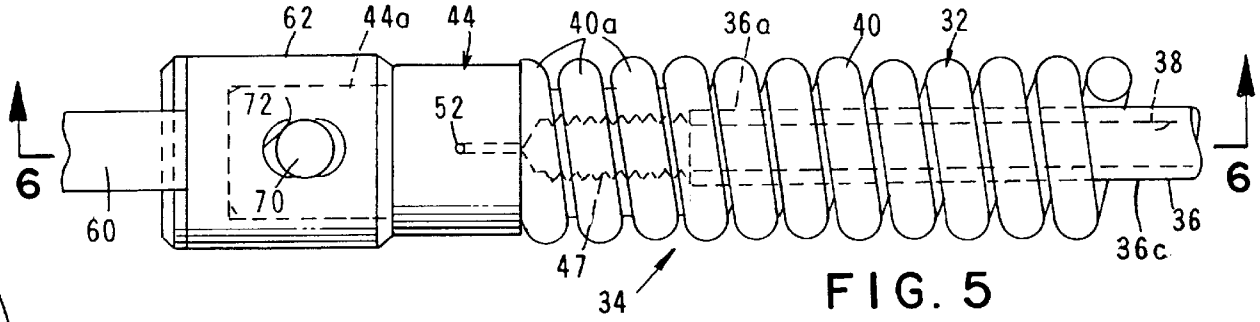
FIG. 5 is a top view of the assembled coiled clean out head assembly shown in FIG. 4.
Figure 6:
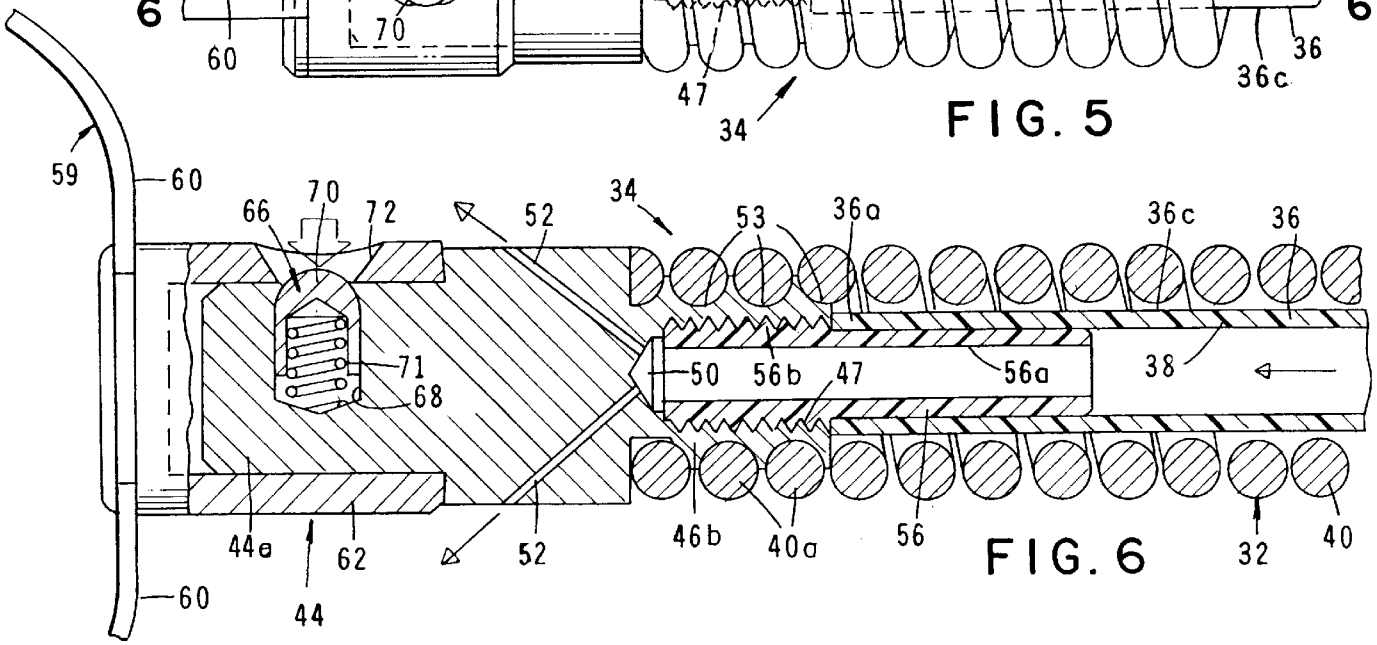
FIG. 6 is a greatly enlarged, cross-sectional view taken along lines 6—6 of FIG. 5.

Forming a highly important aspect of the present invention is the novel coil spring assembly, which here includes an elongated, helically wound spring wire or plumbers' snake 32. During operation of the tool, snake 32 is forced down the waste line "W" (FIG. 3) so as to encounter and break up obstructions that have been formed internally of the waste line. Referring also to FIGS. 4, 5, and 6, it can be seen that the coil spring assembly 34 has a rearward portion which is disposed within the body portion 20 of spring housing 18 and a forward portion 34*b* which extends through the forward guide portion 24 of the spring housing and through the feed means 28. In the form of the invention shown in the drawings, this novel coil spring assembly comprises an elongated, flexible elastomeric tube 36, (FIG. 6), having an internal fluid flow passageway 38. Tube 36 has a forward extremity 36*a* and a rearward extremity 36*b*, which, in a manner presently described, is connected to an external source "S" of water such as a domestic water supply. Helically wound about flexible tube 36 is an elongated spring wire 40 which closely circumscribes the external surface 36*c* of flexible tube 36. Spring wire 40 and the manner of helically coiling the wire about flexible tube 36 is well understood by those skilled in the art.

Interconnected proximate at the forward extremity of coil spring 40 and flexible tube 36 is the novel spray jet head assembly of the invention which is generally designated in the drawings by the numeral 44. The spray jet head assembly here includes a forward head portion 44*a* and a reduced diameter rearward portion 44*b*. As best seen by referring to FIGS. 4 and 6, reduced diameter rearward portion 44*b* is provided with an internally threaded bore 47 which terminates at its inboard end in a fluid distribution chamber 50. Extending angularly outwardly from fluid distribution chamber 50 are a plurality of jet passageways 52 which direct water under pressure outwardly of the spray jet head in a direction toward the cutter head assembly and the inner walls of the waste line.

As indicated in FIGS. 4 and 6, reduced diameter portion 44*b* of spray jet head 44 includes an external surface having a plurality of generally helically shaped grooves which receive a plurality of the wire coils 40*a* formed approximate the outboard extremity of coil spring 40. Grooves 53 function to securely interconnect the spray jet assembly with the coil spring 40 in the manner shown in FIGS. 5 and 6.

Another extremely important aspect of the apparatus of the present invention is the connector means for connecting the spray jet head assembly 44 to the elongated flexible tube 36 of the coil spring assembly. This important connector means not only physically interconnects the spray jet head to the flexible tube, but also importantly places the internal passageway 38 of the tube in free fluid communication with the fluid distribution chamber 50 and, in turn, with the plurality of spray jet passageways 52 formed in spray jet head 44. This important connector means of the invention here comprises a generally tubular shaped connector member 56 of the character shown in FIG. 4. Connector member 56 has an elongated, first or shank portion 56*a* which is telescopically received within internal passageway 38 of tube 36 and a second externally threaded portion 56*b* adapted to be threadably interconnected with internally threaded bore 47 provided in spray jet head 44. Connector member 56 can be constructed from a wide variety of materials, including various metals, elastomers and plastics. When connector 56 is interconnected with tube 36 and spray jet head 44 in a manner shown in FIG. 6, both the elongated tube 36 and the coil spring 40 are securely interconnected with the spray jet head assembly 44.

Connected to forward portion 44*a* of spray jet head 44, is a cutter means for cutting into and removing obstructions such as clogs formed in the waste line "W" being cleaned. In the present form of the invention the cutter means comprises a specially shaped cutter blade assembly 59, which includes outwardly extending curved cutter blades 60 and a generally tubular shaped connector housing 62. As indicated in FIG. 6, connector housing 62 is adapted to closely telescopically receive the forwardly disposed, reduced diameter portion 44*a* of spray jet head 44. To removably interconnect the cutter means with the spray jet head, finger operated connector means are provided. These finger operated connector means here comprise a conventional detent assembly generally designated in the drawings by the number 66. This detent assembly 66 is housed within a generally, radially extending bore 68, provided in spray jet head 44. Detent assembly 66 includes a finger engaging, dome shaped member 70, which is continuously biased in an outwardly direction by biasing means, here shown as a coil spring 71 which is housed internally of dome shaped member 70 and extends into radial bore 68 in a manner to continuously urge the upper portion of dome shape member 70 outwardly through a tapered aperture 72 formed in tubular shaped housing 62. With this construction, a finger pressure exerted inwardly on dome shaped member 70 will depress the detent in a manner to permit sleeve 62 to be slipped forwardly of spray jet housing 44 and removed therefrom. Once the cutter assembly has been removed from the spray jet housing either another cutter assembly such as that shown in FIG. 3A, or some other obstruction removal means can be removably interconnected with the spray jet head 44.

Figures 7, 8:
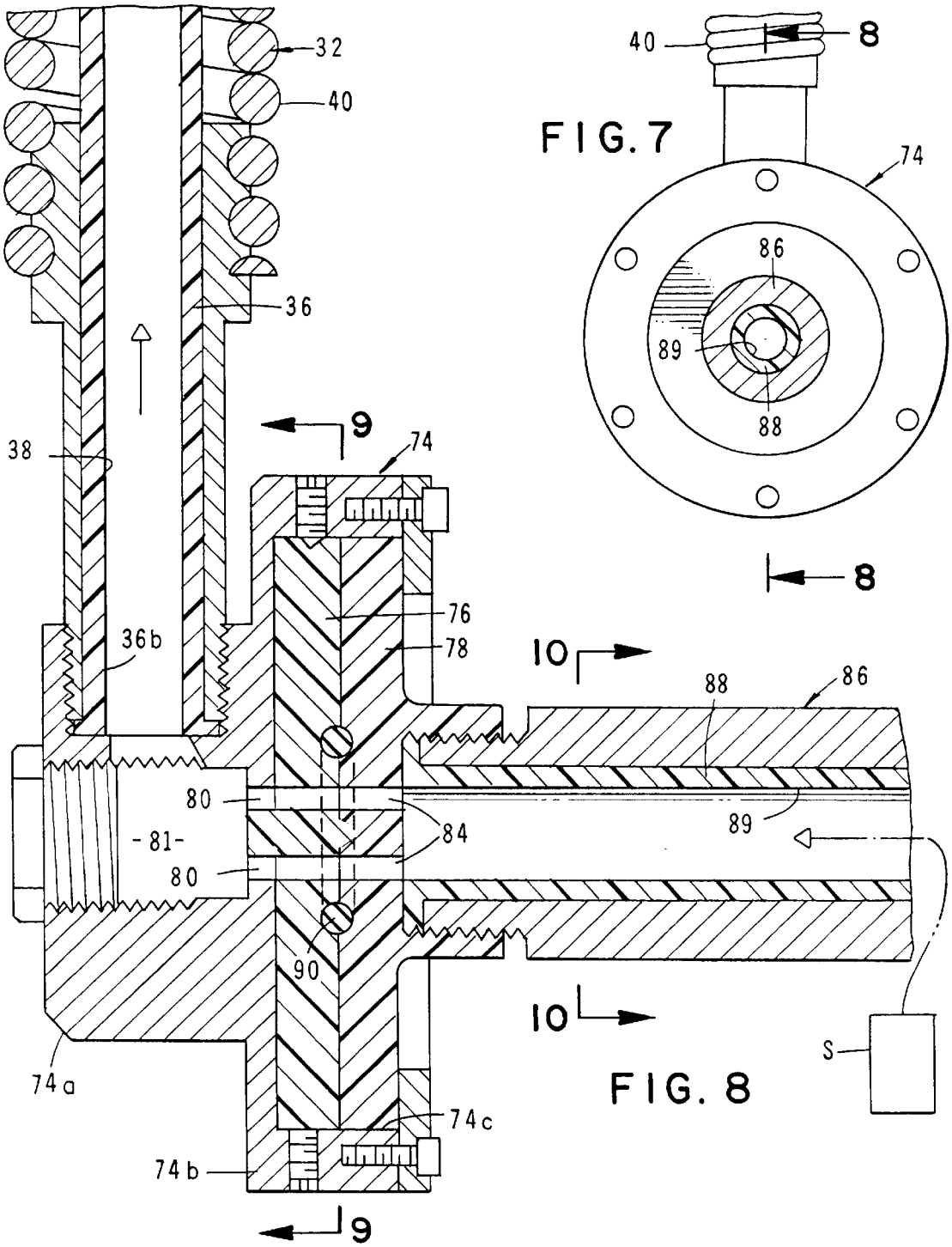
FIG. 7 is an enlarged front view, partly in cross section of the fastener or swivel means of the invention for interconnecting the coil spring assembly with a source of water under pressure.
FIG. 8 is a greatly enlarged cross-sectional view taken along lines 8—8 of FIG. 7.
Figure 9:
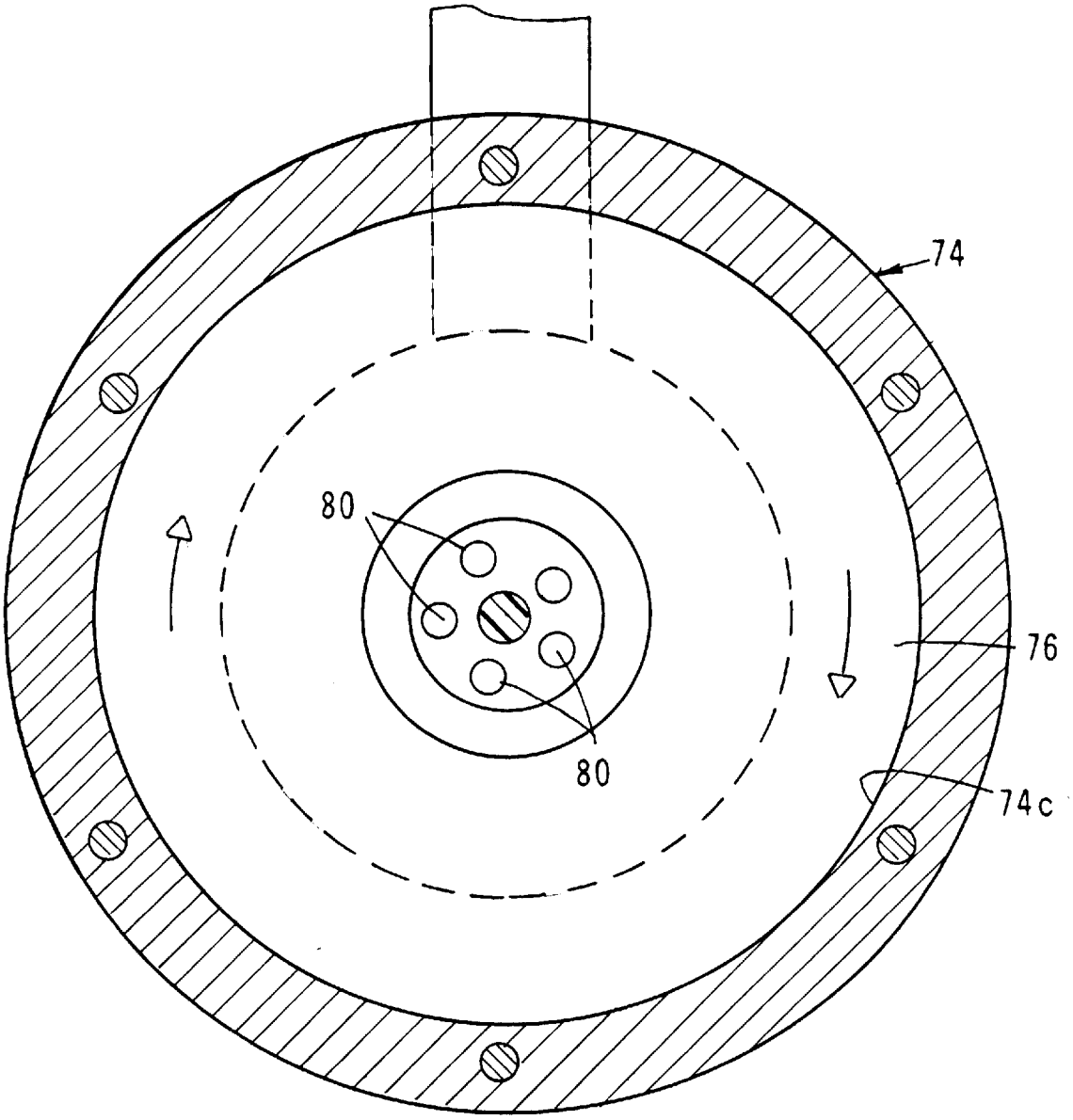
FIG. 9 is a cross-sectional view taken along lines 9—9 of FIG. 8.
Figure 10:
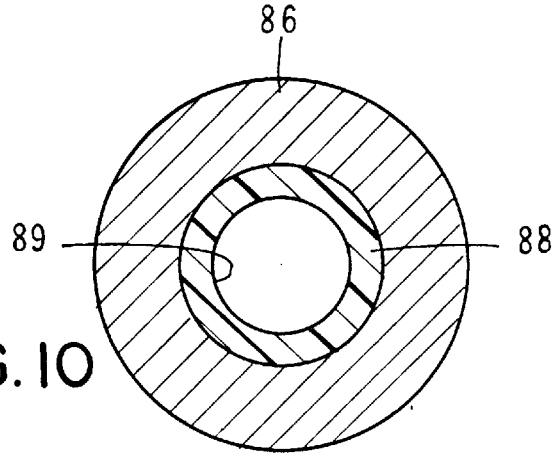
FIG. 10 is a cross-sectional view taken along lines 10—10 of FIG. 8.

Turning next to FIGS. 7 through 10, the important fastening means of the invention for connecting the internal passageway 38 of tube 36 with a source of water under pressure is there illustrated. In the present form of the invention, this important fastening means comprises a housing 74 disposed within spring housing 18 (FIG. 2). Housing 74 includes a hollow internally threaded hub portion 74*a* and a chamber defining portion 74*b* defining a hollow chamber 74*c*. Disposed within chamber 74*c* are two sealably interconnected relatively rotatable first and second swivel plates 76 and 78 respectively. As best seen in FIG. 9, first swivel plate 76 is provided with a plurality of circumferentially spaced apart fluid passageways 80. Fluid passageways 80 communicate with the internal fluid chamber 81 defined by hollow hub portion 74*a* and also communicate with a plurality of fluid passageways 84 formed in second swivel plate 78. Also forming a part of the fastening means of this form of the invention is means for connecting second fluid passageways 84 of second swivel plate 78 with a remotely located source of fluid "S" under pressure. This latter means comprises an elongated tube 86 which is threadably connected to second swivel plate 78 as seen in FIG. 8. Housed within tube 86 is a second tube 88 which defines an internal fluid passageway 89. In a manner well understood by those skilled in the art, tubes 86 and 88 can be interconnected with a source of water under pressure such as a domestic water source generally illustrated in FIG. 8 and designated by the letter "S".

With the waste line clean out apparatus in the assembled configuration shown in FIG. 2, cleaning of the clogged waste line "W" can be accomplished by first inserting the cutter means along with the outboard end of the coil spring assembly into the waste line to be cleaned in the manner shown in FIG. 3. This done, using foot switch 31, motor 30 is energized to cause rotation of spring housing 18 and rotation of the coil spring assembly housed therewithin. It is to be understood as housing 18 rotates, the fastening means of the invention, which is disposed within spring housing 18, will also rotate as will the portion of the coil spring which is initially coiled within hollow spring housing 18. Operation of the feed means 28 will then cause the coil spring to be controllably withdrawn from the spring housing and advanced through the waste line to be cleaned via guide portion 24 and feed means 28. Upon the cutter means engaging the obstruction within the waste line water from pressurized water source "S" is introduced into passageway 89 of tube 88. Tube 86 as well as swivel plate 78 are, of course, stationary. However, due to the fact that drum 18 is being rotated by electric motor 30, swivel plate 76 will also be rotated relative to plate 78 in a manner such that water flowing through passageways 84 and plate 78 will flow freely through passageways 80 formed in plate 76. As shown in FIG. 8, to prevent leakage of water between plates 76 and 78, sealing means, shown here in a form of an elastomeric O-Ring 90, is disposed between the plates 76 and 78. Water under pressure flowing through passageway 80 will flow into chamber 81 and then advance within internal passageway 38 of flexible tube 36. The water will next flow into distribution chamber 50 (FIG. 6) and thence outwardly under pressure through the plurality of angularly outwardly extending jet passageways 52 formed in jet head 44. This water flowing through passageway 52 is strategically directed toward the cutting means or blades 60 so as to assist in the breakdown and clearing away obstructions formed within the waste line. By strategically directing the high pressure jets of water toward the obstruction and toward the cutting blades 60, significant cutting improvement of the cutting means is achieved and at the same time clearing of the obstruction is greatly facilitated.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

I claim:

1. A waste line clean out tool comprising:

(a) a supporting frame;

(b) a spring housing rotatably mounted on said supporting frame, said spring housing including a generally annular shaped body portion having a rear wall and a generally frustoconically shaped forward guide portion;

(c) a coiled spring assembly having a rearward portion disposed within said body portion of said spring housing and a forward portion extending through said forward guide portion of spring housing, said coiled spring assembly comprising:

(i) an elongated flexible tube defining an internal passageway;

(ii) an elongated helically wound spring wire wound about said elongated flexible tube;

(iii) a spray jet head having a forward portion and a rearward portion, said rearward portion being connected to said flexible tube and to said spring wire, said spray jet head having a plurality of outwardly extending jet passageways formed therein;

(iv) connector means for connecting said spray jet head to said flexible tube to place said internal passageway thereof in fluid communication with said plurality of outwardly extending jet passageways, said connector means comprising a generally tubular shaped connector member having a first portion telescopically received within said internal passageway of said flexible tube and a second portion connected to said spray jet head;

(d) feed means connected to said frame for removable engagement with said forward portion of said coiled spring assembly to controllably withdraw a portion of said coiled spring assembly from said spring housing through said forward guide portion thereof;

(e) drive means connected to said frame for rotating said spring housing about the central axis thereof.

2. A clean out tool as defined in claim 1 further including fastening means for connecting said internal passageway of said flexible tube with a source of water under pressure, said fastening means comprising:

(a) a housing disposed with said spring housing and rotatable therewith, said housing having a hollow hub portion and a chamber defining portion defining a hollow chamber;

(b) means for connecting said flexible tube to said hollow hub portion;

(c) a first swivel plate mounted within said chamber, said first swivel plate having a fluid passageway in communication with said hollow hub portion of said housing;

(d) a second plate mounted within said chamber in sealing engagement with said first plate, said first and second plates being relatively movable as said spring housing rotates, said second plate including a fluid passageway for communication with said fluid passageway of said first plate as said spring housing rotates; and (e) means for connecting said second plate with a source of water under pressure.

3. A waste line clean out tool as defined in claim 1 further including cutter means for cutting into waste line clogs, said cutter means comprising a cutter blade connected to and extending outwardly from said forward portion of said spray jet head.

4. A waste line clean out tool as defined in claim 1 in which said rearward portion of said spray jet head is provided with a plurality of helical grooves for connectably receiving a portion of said helically wound spring wire.

5. A waste line clean out tool as defined in claim 1 in which said rearward portion of said spray jet head is provided with an internally threaded bore and in which said second portion of said tubular shaped connector member is provided with external threads for threadable interconnection with said internally threaded bore of said rearward portion of said spray jet head.

6. A waste line clean out tool as defined in claim 5 in which said internally threaded bore formed in said rearward portion of said spray jet head terminates in a fluid distribution chamber in fluid communication with said plurality of outwardly extending jet passageways.

7. A waste line clean out tool comprising:

(a) a supporting frame;

(b) a spring housing rotatably mounted on said supporting frame, said spring housing including a generally frustoconically shaped forward guide portion;

(c) a coiled spring assembly having a rearward portion disposed within a body portion of said spring housing and said forward guide portion of said spring housing, said coiled spring assembly comprising:

(i) an elongated flexible tube defining an internal passageway;

(ii) an elongated helically wound spring wire wound about said elongated flexible tube;

(iii) a spray jet head connected to said spring wire, said spray jet head having a forward portion and a rearward reduced diameter portion having an internally threaded bore terminating in a fluid distribution chamber and an external surface provided with a portion of said helically wound spring wire, said spray jet head further having a plurality of outwardly extending jet passageways formed therein and in fluid communication with said fluid distribution chamber;

(iv) connector means connecting said spray jet head to said flexible tube to place said internal passageway thereof in fluid communication with said fluid distribution chamber of said spray jet head, said connector means comprising a generally tubular shaped connector member having a first portion telescopically received within said internal passageway of said flexible tube and a second, externally threaded portion for threadable interconnection with said internally threaded bore of said spray jet head;

(d) feed means connected to said frame for removable engagement with said forward portion of said coiled spring assembly to controllably withdraw a portion of said coiled spring assembly from said spring housing through said forward guide portion thereof; and (e) drive means connected to said frame for rotating said spring housing about the central axis thereof.

8. A waste line clean out tool as defined in claim 7 further including cutter means for cutting into waste line clogs, said cutter means comprising a cutter blade connected to and extending outwardly from said forward portion of said spray jet head.

9. A waste line clean out tool as defined in claim 8 in which said cutter means further comprises a generally tubular shaped housing connected to said cutter blade said forward portion of said spray jet head being telescopically received within said tubular shaped housing.

10. A waste line clean out tool as defined in claim 8 further including finger operated connecting means for removably connecting said cutter means to said spray jet head.

11. A waste line clean out tool as defined in claim 10 in which said forward portion of said spray jet head is provided with a radially extending bore and in which said finger operated connecting means comprises a detent assembly disposed within said radially extending bore.

12. A waste line clean out tool comprising:

(a) a supporting frame;

(b) a spring housing rotatably mounted on said supporting frame, said spring housing including a generally frustoconically shaped forward guide portion;

(c) a coiled spring assembly having a rearward portion disposed within a body portion of said spring housing and said forward guide portion of said spring housing, said coiled spring assembly comprising:

(i) an elongated flexible tube defining an internal passageway;

(ii) an elongated helically wound spring wire wound about said elongated flexible tube;

(iii) a spray jet head connected to said spring wire, said spray jet head having a forward portion and a rearward reduced diameter portion having an internally threaded bore terminating in a fluid distribution chamber and an external surface provided with a portion of said helically wound spring wire, said spray jet head further having a plurality of outwardly extending jet passageways formed therein and in fluid communication with said fluid distribution chamber;

(iv) connector means connecting said spray jet head to said flexible tube to place said internal passageway thereof in fluid communication with said fluid distribution chamber of said spray jet head, said connector means comprising a generally tubular shaped connector member having a first portion telescopically received within said internal passageway of said flexible tube and a second, externally threaded portion for threadable interconnection with said internally threaded bore of said spray jet head;

(d) feed means connected to said frame for removable engagement with said forward portion of said coiled spring assembly to controllably withdraw a portion of said coiled spring assembly from said spring housing through said forward guide portion thereof;

(e) drive means connected to said frame for rotating said spring housing about the central axis thereof; and (f) cutter means for cutting into waste line clogs, said cutter means comprising a cutter blade connected to and extending outwardly from said forward portion of said spray jet head.

13. A waste line clean out tool as defined in claim 12 in which said cutter means further comprises a generally tubular shaped housing connected to said cutter blade, said forward portion of said spray jet head being telescopically received within said tubular shaped housing.

14. A waste line clean out tool as defined in claim 13 further including finger operated connecting means for removably connecting said cutter means to said spray jet head.

15. A waste line clean out tool as defined in claim 14 in which said forward portion of said spray jet head is provided with a radially extending bore and in which said finger operated connecting means comprises a detent assembly disposed within said radially extending bore.

* * * * *